US005606957A

United States Patent [19]

Feucht

[11] Patent Number: 5,606,957

[45] Date of Patent: Mar. 4, 1997

[54] CONTROL SYSTEM FOR EXHAUST GAS RECIRCULATION

[75] Inventor: Dennis D. Feucht, Morton, Ill.

[73] Assignee: Caterpillar Inc., Peoria, Ill.

[21] Appl. No.: 568,217

[22] Filed: Dec. 6, 1995

[51] Int. Cl.[6] ..... F02M 25/07

[52] U.S. Cl. ..... 123/571; 251/129.11

[58] Field of Search ..... 123/569, 571; 137/528; 251/129.11, 129.12, 129.13

[56] References Cited

U.S. PATENT DOCUMENTS

| | | | |
|---|---|---|---|
| 2,092,563 | 9/1937 | Tucker | 74/424.8 B |
| 2,193,474 | 3/1940 | Braver | 222/16 |
| 2,213,488 | 9/1940 | Dowrick et al. | 137/630.15 |
| 3,704,853 | 12/1972 | Waller | 251/59 |
| 4,013,264 | 3/1977 | Friedell | 251/56 |
| 4,130,030 | 12/1978 | Stratienko | 74/625 |
| 4,428,398 | 1/1984 | Mito et al. | 137/530 |
| 4,455,987 | 6/1984 | Sudbeck et al. | 123/571 |
| 4,473,056 | 9/1984 | Ishida et al. | 123/571 |
| 4,589,396 | 5/1986 | Tokushima et al. | 123/559.3 |
| 4,782,811 | 11/1988 | Hewette et al. | 123/571 |
| 4,909,212 | 3/1990 | Minowa et al. | 123/337 |
| 5,184,593 | 2/1993 | Kobayashi | 123/571 |
| 5,349,983 | 9/1994 | Ozarowski et al. | 137/487.5 |
| 5,503,131 | 4/1996 | Ohuchi | 123/571 |

*Primary Examiner*—Willis R. Wolfe
*Attorney, Agent, or Firm*—J. W. Burrows

[57] ABSTRACT

An exhaust valve controlling system of an exhaust gas recirculation system of an engine has a stepper motor that is electrically controlled to actuate first and second spring systems that are associated with a one way clutch system which raises and lowers an exhaust valve in response to rotation of a spool threadably mated with a threaded end portion of the valve stem.

6 Claims, 2 Drawing Sheets

28
66
64
68
2
36
22
52
46
44
24
42
20
26
50
32
14
4
48
34
30
62
54
60
38
58
56
8
12
16
6
18
10

CONTROL SYSTEM FOR EXHAUST GAS RECIRCULATION

TECHNICAL FIELD

This invention resides in an electrical control system for controlling the opening, closing and positioning of a valve of an exhaust gas recirculation system of an engine.

BACKGROUND ART

In the operation of a control system for controlling the opening and closing of a valve of an exhaust gas recirculation system of an engine, it is desirable to provide fast return of the valve to the closed position. In order to provide fast return, it is desirable to have a driving system which requires little movement to accomplish complete closing of the valve from the completely open position. In such a system, it is desirable that high seating forces are provided to prevent valve opening from exhaust pulses and that the valve can be stopped at a multiplicity of positions.

Although a considerable amount of innovation has been undertaken in this art, heretofore utilized systems have short comings in one or more of the desirable features.

The subject invention is directed to overcome one or more of the problems associated with heretofore utilized systems.

BRIEF DESCRIPTION OF THE INVENTION

An exhaust gas recirculation system has a valve having a valve stem. The valve is moveable between a first position blocking communication of an engine intake air passageway with an engine exhaust gas passageway and a second position at which the passageways are in communication. The recirculation system has a frame, a stepper motor for moving the valve between the first and second positions, a driving element connected to the stepper motor, a one way clutch system connected to the driving element and control means for rotating the stepper motor in preselected first and second directions and controllably stopping the stepper motor at preselected positions of the valve. The valve stem has a threaded first end portion mated with internal threads of a spool that is connected to the drive element of the stepper motor through the one way clutch. A clockwork spring is connected to the spool and adapted to store energy in response to rotation of the spool in a first direction and controllably release energy and rotate the spool in a second direction. A thrust mechanism maintains the spool against axial movement and an anti-rotation device maintains the valve against rotation.

BEST MODE OF THE INVENTION

Figure 1:
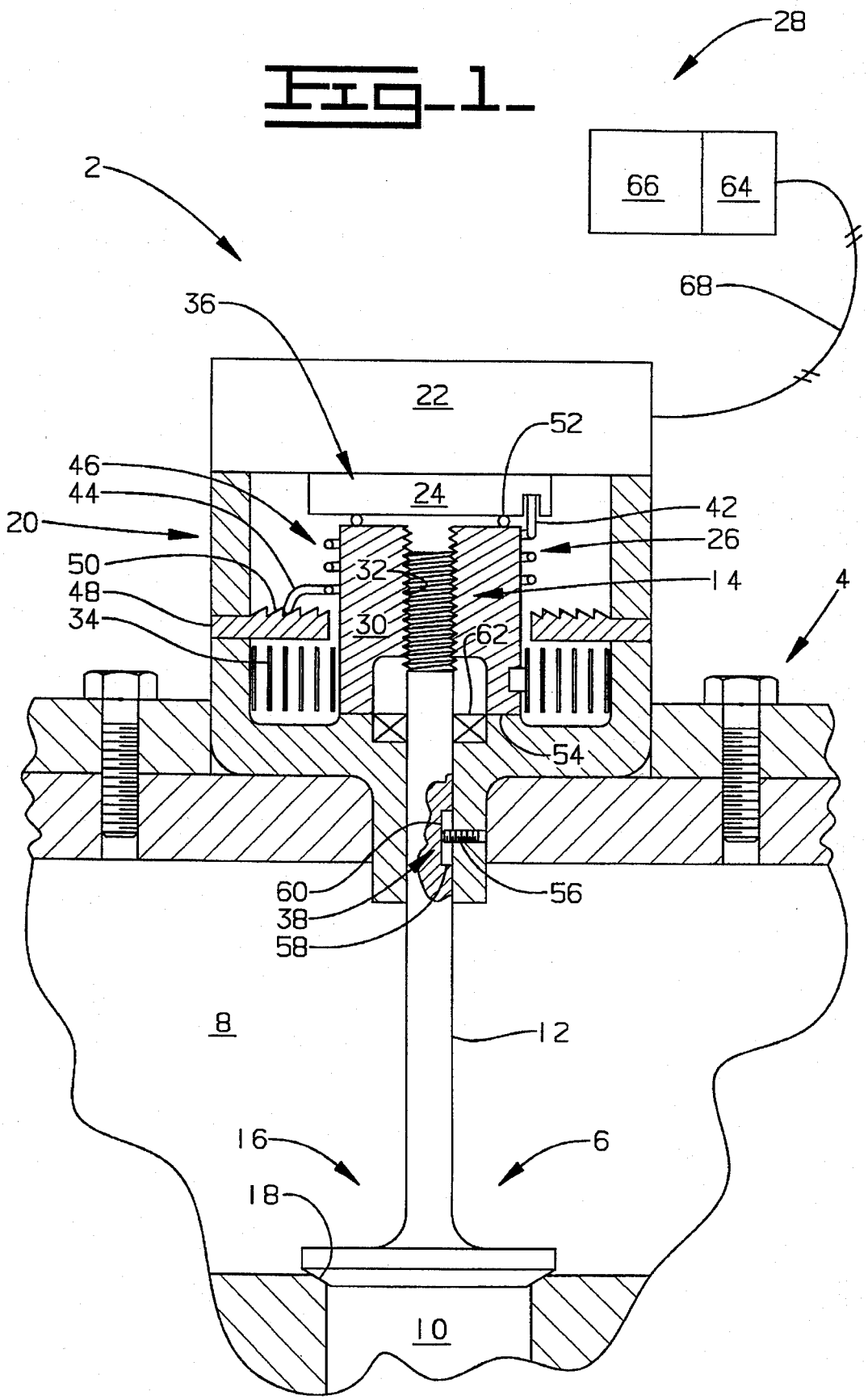
FIG. 1 is a diagrammatic view in partial section showing the subject invention.

Referring to FIG. 1, an exhaust gas recirculation system (EGR) 2 is shown on an engine 4. The EGR system has an exhaust valve 6 associated with the engine intake air passageway 8 and exhaust gas passageway 10. The valve 6 has a valve stem 12 which has a threaded first end portion 14 and a second end portion 16 that cooperates with a seat 18 of the exhaust gas passageway 10.

The valve 6 is moveable between a first position at which communication is blocked between the intake air passageway 8 and the exhaust gas passageway 10 and a second position at which the passageways 8, 10 are in communication.

The EGR system has a frame mechanism 20, an electrically operated stepper motor 22 for moving the valve 6 between the first and second positions, a driving element 24 connected to the stepper motor 22, and a one way clutch system 26 connected to the driving element 24. Controlling means 28 are provided for rotating the stepper motor 22 in preselected first and second directions and controllably stopping the stepper motor 22 at preselected positions of the valve 6.

A spool 30 has an axis and internal threads 32 mated with the threaded end portion 14 of the valve stem 12. The spool 30 is connected to the driving element 24 of the stepper motor 22 through the one way clutch system 26.

Figure 2:
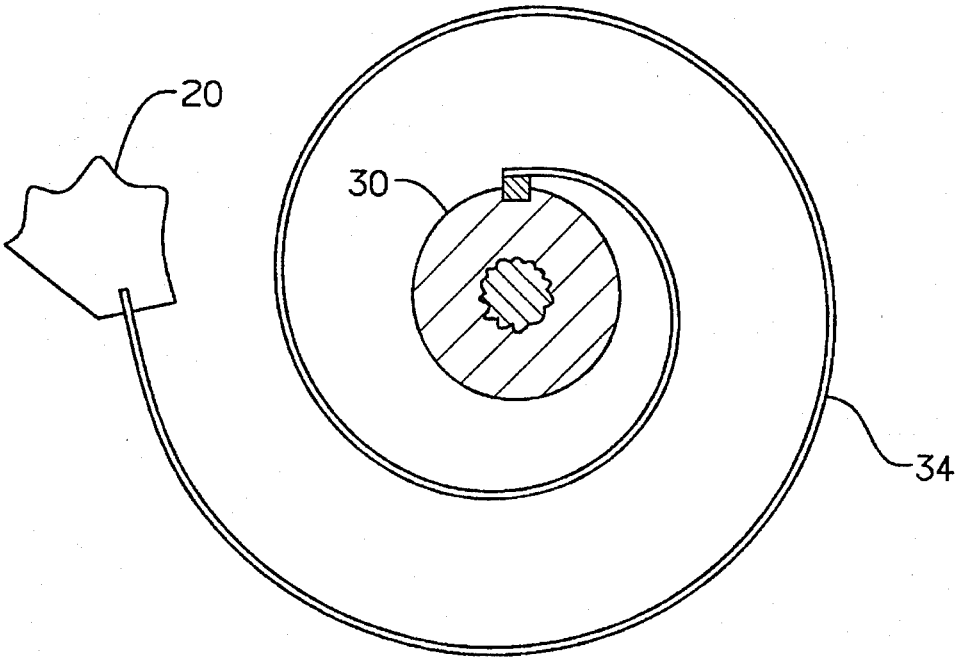
FIG. 2 is a diagrammatic top view of a spring of this invention.

Referring to FIGS. 1 and 2, a clockwork spring 34 is connected at one end to the spool 30 and is fixed to the frame mechanism 20 or other fixed member and is adapted to store energy in response to rotation of the spool 30 in a first direction and controllably release energy and rotate the spool 30 in a second direction.

A thrust mechanism 36 is provided for maintaining the spool 30 against axial movement and an anti-rotation device 38 is provided for maintaining the valve 6 against rotation when the spool 30 is rotated.

Referring to FIG. 1, the one way clutch 26 has a helical spring 40 which has first and second end 10 portions 42,44 and a middle portion 46. The first end portion 42 is connected to the driving element 24 and is rotationally moveable therewith. The middle portion 46 is disposed about the outer periphery of the spool 30.

Figure 3:
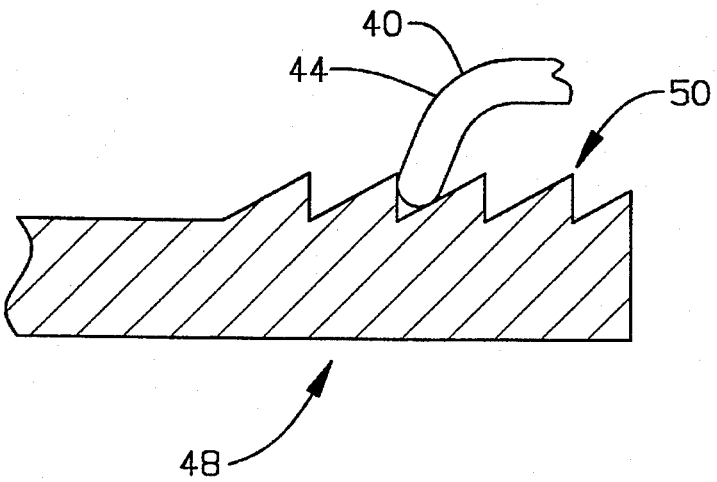
FIG. 3 is a diagrammatic sectioned view of a portion of the one way clutch system.

A control plate 48 or washer shaped member has a first surface 50 and is fixedly connected to the frame 20. The first surface 50 of the control plate 48 is of a generally stepped or "saw tooth" configuration, as shown in FIG. 3, and is in contact with the second end portion 44 of the helical clutch spring 40.

The spool maintaining thrust mechanism 36, as shown in FIG. 1, includes first and second thrust bearings 52,54. The first thrust bearing 52 is positioned between the spool 30 and the driving element 24 and the second thrust bearing 54 is positioned between the spool 30 and the frame mechanism 20.

The anti-rotation device 38 includes a guiding element 56 located in the frame mechanism 20. It should be understood that the guiding element 56 can be an integral part of the frame mechanism 20 or could be a separate element without departing from this invention. A keyway 58, as is well known in the art, is defined in the valve stem 12 and operative to receive the guiding element 56. The guiding element 56 disposed in the keyway 58 prohibits the valve 6 from rotating when the spool 30 is rotated. A bearing 62 is connected to the frame 20 and the guiding element 56 for reducing rotational friction therebetween.

The controlling means 28 includes an electrical sensor 66 that is associated with an engine speed controlling system 64 and the stepper motor 22 and is adapted to stop the opening of the valve 6 at preselected positions in response to receipt of a signal via line 68 in response to a signal from the sensor 66 correlated to preselected engine speeds or other engine operating conditions.

Industrial Applicability

In the operation of the EGR system of this invention, a signal is delivered to the stepper motor 22 to open the valve 6. The stepper motor 22 is energized and rotates the driving element 24 in a first direction. As the driving element 24 rotates, it causes the helical spring 40 of the one way clutch system 26 to decrease in diameter and fictionally lock the driving element 24 to the spool 30, thereby causing the spool 30 to rotate with the driving element 24.

Since the spool 30 is maintained against axial movement and is threadably mated with threads of the valve stem 12, as the spool rotates in the first direction, the valve 6 is moved from the valve seat 18 and interconnects the passageways 8,10 of the EGR system 2. The second end portion 44 of the spring 40 abuts the stops of the control plate and provides the reaction force for maintaining the spring 40 in forcible contact with the spool 30. As the spool 30 rotates to raise the valve 6 from the seat, the coils of the clockwork spring 34 is tightened and stores energy.

In response to a signal received by the stepper motor 22 to return the valve 6 to its seat, the stepper motor 22 is responsively rotated in a second direction. This second direction rotation immediately disengages the one way clutch system 26 and frees the spool 30 to be rapidly rotated in the opposite direction by the energy stored in the clockwork spring 34.

As an engine idles, it is desirable to position the valve 6 for mixing of exhaust gas with the incoming air. Upon sudden demand of engine power, the valve must be rapidly closed so there will be sufficient oxygen intake to accommodate the substantially complete burning of the increased amount of fuel that is being delivered. A similar requirement occurs whenever the engine is operating with the valve open and there is a sudden increase in demand for more engine power. Because of the operating mode of this device, whenever a smaller valve open position, as compared to the current set position, is requested the valve will be released and closed and then reopened to the new smaller set position.

Other aspects, objects, and advantages of the present system can be obtained from a study of the specification, the drawings and the appended claims.

I claim:

1. In an exhaust gas recirculation system having a valve having a valve stem, said valve being moveable between a first position blocking communication of an engine intake air passageway with an engine exhaust gas passageway and a second position at which said passageways are in communication, a frame mechanism, a stepper motor for moving the valve between the first and second positions, a driving element connected to the stepper motor, a one way clutch system connected to the driving element, and control means for rotating the stepper motor in preselected first and second directions and controllably stopping the stepper motor at preselected positions of the valve, the improvement comprising:

said valve stem having a threaded first end portion;

a spool having an axis and internal threads mated with the threads of the valve stem and being connected to the drive element of the stepper motor through the one way clutch;

a clockwork spring connected to the spool and being adapted to store energy in response to rotation of the spool in a first direction and controllably release energy and rotate the spool in a second direction;

a thrust mechanism operative to maintain the spool against axial movement; and an anti-rotation device operative to maintain the valve against rotation relative to the spool.

2. A system, as set forth in claim 1, wherein the one way clutch system has a helical spring having first and second end portions and a middle portion, said first end portion of the helical spring being connected to the driving element and moveable therewith and said middle portion being disposed about the spool; and a control plate having a first surface in contact with the second end portion of the helical spring, said control plate first surface being of saw tooth configuration.

3. A system, as set forth in claim 1, wherein the spool maintaining thrust mechanism includes first and second thrust bearings each positioned on a respective end of the spool, said first thrust bearing being positioned between the spool and the driving element and said second thrust bearing being positioned between the spool and the frame mechanism.

4. A system, as set forth in claim 1, wherein the valve stem has a keyway defined therein and the anti-rotation device includes a guiding element located in the frame mechanism and disposed in the keyway in the valve stem to prevent relative rotation between the spool and the valve.

5. A system, as set forth in claim 1, including a bearing located in the frame mechanism and disposed about the valve stem.

6. A system, as set forth in claim 1, including an engine speed controlling system and a sensor associated with the engine speed control system and the stepper motor and being operative to stop the opening of the valve at an intermediate position in response to receipt of a signal from the sensor that is correlated to preselected engine speeds.

* * * * *